US007222982B2

(12) United States Patent
Philippeau

(10) Patent No.: US 7,222,982 B2
(45) **Date of Patent: *May 29, 2007**

(54) ILLUMINATED ARTICLE

(75) Inventor: Jerry M. Philippeau, Peru, IL (US)

(73) Assignee: Flipo Group Limited, LaSalle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/414,962

(22) Filed: May 1, 2006

(65) Prior Publication Data

US 2006/0193123 A1 Aug. 31, 2006

Related U.S. Application Data

(63) Continuation of application No. 10/817,989, filed on Apr. 5, 2004, now Pat. No. 7,066,614.

(60) Provisional application No. 60/460,588, filed on Apr. 4, 2003.

(51) Int. Cl.
*F21V 21/08* (2006.01)

(52) U.S. Cl. ..... 362/104; 362/644

(58) Field of Classification Search ..... 362/104, 362/644, 800, 806; 439/660, 37, 38, 39
See application file for complete search history.

(56) References Cited

U.S. PATENT DOCUMENTS

| | | | | |
|---|---|---|---|---|
| 4,954,931 | A * | 9/1990 | Hassler, Jr. | 362/555 |
| 5,201,578 | A | 4/1993 | Westmoland | |
| 5,477,433 | A * | 12/1995 | Ohlund | 362/104 |
| 5,876,109 | A * | 3/1999 | Scalco | 362/104 |
| 6,122,933 | A | 9/2000 | Ohlund | |
| 6,296,364 | B1 | 10/2001 | Day et al. | |
| 6,478,619 | B1 * | 11/2002 | Wiechmann | 439/587 |
| 6,601,965 | B2 | 8/2003 | Kamara | |
| 6,626,009 | B1 * | 9/2003 | Ohlund | 63/3.1 |
| 6,819,056 | B2 * | 11/2004 | Lin | 315/185 S |

* cited by examiner

*Primary Examiner*—Sandra O'Shea
*Assistant Examiner*—Mark Tsidulko
(74) *Attorney, Agent, or Firm*—Husch & Eppenberger LLC; Robert C. Haldiman

(57) ABSTRACT

A decorative stone impregnated with a transmutable lighting element, such as a light emitting diode, electrically connected to a power source. The lighting element contains an integrated circuit which controls its transmutable appearance. The decorative stone may be used in jewelry.

18 Claims, 6 Drawing Sheets

ILLUMINATED ARTICLE

CROSS-REFERENCE TO RELATED APPLICATIONS

This application is a continuation of U.S. patent application Ser. No. 10/817,989 filed on Apr. 5, 2004 now U.S. Pat. No. 7,066,614 and claims priority from U.S. Provisional Patent Application No. 60/460,588, filed Apr. 4, 2003 and U.S. Design Application Ser. No. 29/194,532, filed Nov. 25, 2003.

STATEMENT REGARDING FEDERALLY SPONSORED RESEARCH

Not Applicable.

Appendix

Not Applicable.

BACKGROUND OF THE INVENTION

1. Field of the Invention

The present invention relates generally to illuminated articles and, more particularly, to an article having a transmutable lighting element with an integrated circuit and a decorative stone.

2. Related Art

U.S. Pat. No. 5,201,578 to Westmoland discloses an article of jewelry having two plates which sandwich a battery between them and electrically connected to a lighting element. In some embodiments, the article includes a microchip to vary the illumination characteristics of the lighting element. Westmoland does not disclose the combination of a transmutable lighting element and a decorative stone.

U.S. Pat. No. 5,477,433 to Ohlund discloses an illuminated necklace having a plurality of electrically conductive beads, a power source, and an illuminated pendant. When a person wearing the necklace moves, the beads intermittently form an electrical circuit thereby causing the pendant to flash. Ohlund does not disclose a transmutable lighting element wherein the colors fade from one to the next.

U.S. Pat. No. 6,296,364 to Day et al. discloses a light-emitting beaded necklace having a plurality of selectively illuminated beads and a pendant. The beads and the pendant are connected to an integrated circuit which causes each item to be illuminated sequentially. Day also does not disclose a transmutable lighting element wherein the colors fade from one to the next nor the combination of a transmutable lighting element and a decorative stone.

U.S. Pat. No. 6,601,965 to Kamara discloses an article of jewelry having two plates which sandwich a battery between them and electrically connected to a lighting element. Kamara does not disclose the combination of a transmutable lighting element, a decorative stone and a two-part switch.

SUMMARY OF INVENTION

It is in view of the above problems that the present invention was developed. The invention is an article of jewelry, such as a necklace, having a transmutable lighting element, such as a light emitting diode, with an electrical circuit, and a decorative stone. The decorative stone is impregnated with the transmutable lighting element. The lighting element contains an integrated circuit which controls its transmutable appearance. The lighting element is selectively connected to a power source by a two-part switch having magnetic elements to hold the two-parts together.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
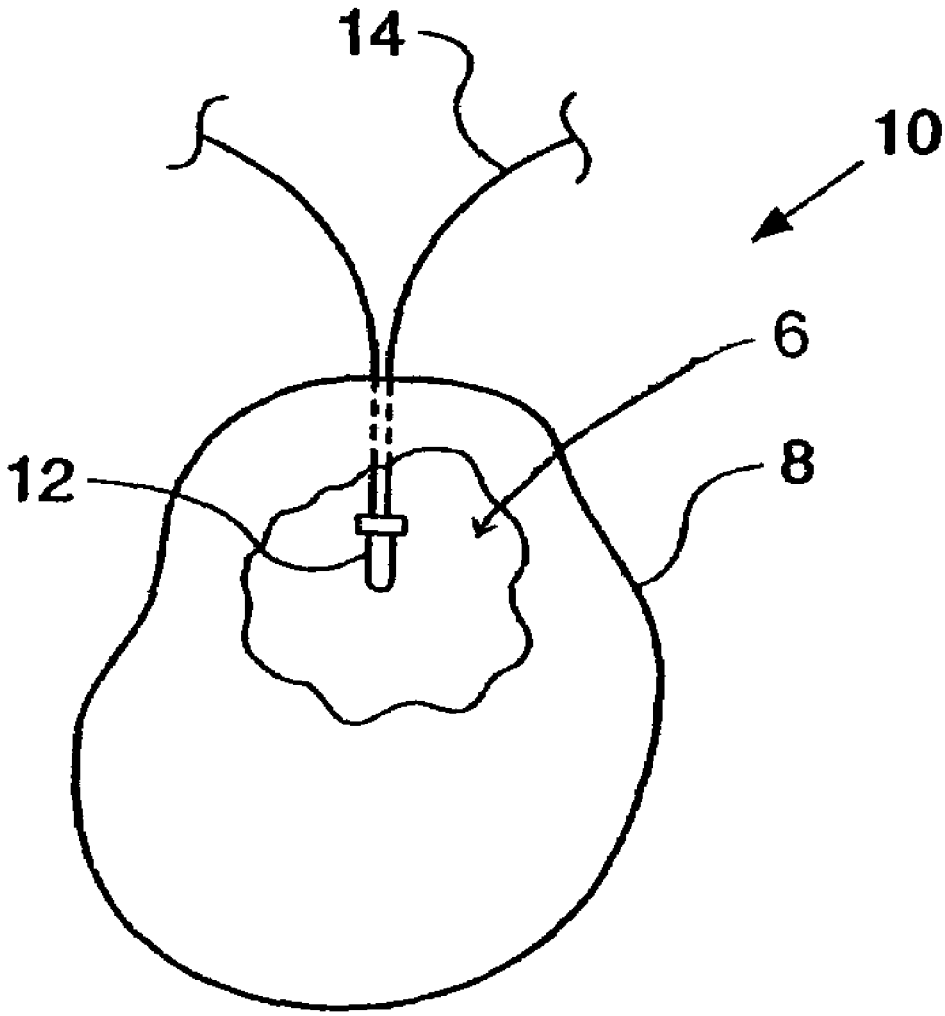
FIG. 1 illustrates an article of jewelry having a decorative stone and a transmutable lighting element.

Referring to the accompanying drawings in which like reference numbers indicate like elements, FIG. 1 illustrates an article of jewelry 10 having a decorative stone 8 impregnated with a transmutable lighting element 12 electrically connected to a power source (not shown). While the decorative stone 8 is depicted as being orb shaped, other shapes, such as star, heart, half-moon, or animal shapes, could equally be used. The decorative stone 8 includes a void 6 for receiving the transmutable lighting element 12. Epoxy resin is used to fill the void 6 and hold the transmutable lighting element 12 in place. In the depicted embodiments, the decorative stone 8 is made of rose quartz. However, in some embodiments the decorative stone 8 comprises opaque plastic, rubber, crystal, or resin material. In the depicted embodiment, the transmutable lighting element 12 is electrically connected by a wire 14. The wire 14 is made from stainless steel and is coated with nylon. The lighting element 12, such as a light emitting diode (LED), contains an integrated circuit which controls its transmutable appearance. In the depicted embodiment, the lighting element 12 repetitively emits seven colors, one at a time with a fading transition between each color. The power source is a battery or solar powered electrical cell. For example, the power source may be two 3 Volt lithium batteries in series.

Figure 2A:
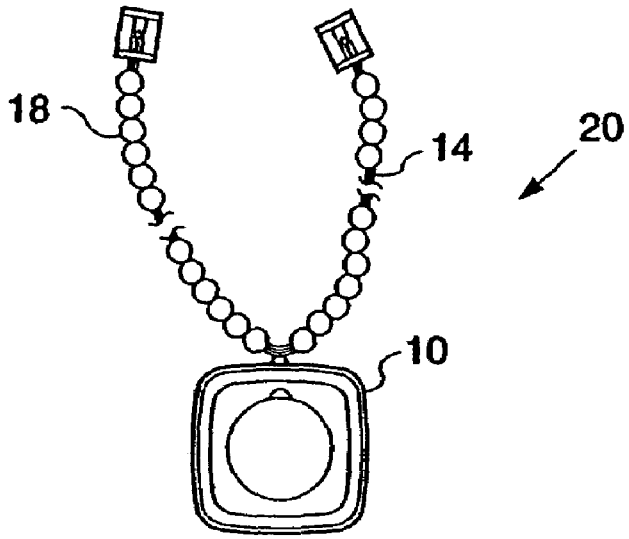
FIG. 2*a* illustrates the article of jewelry in the form of a necklace.
Figure 2B:
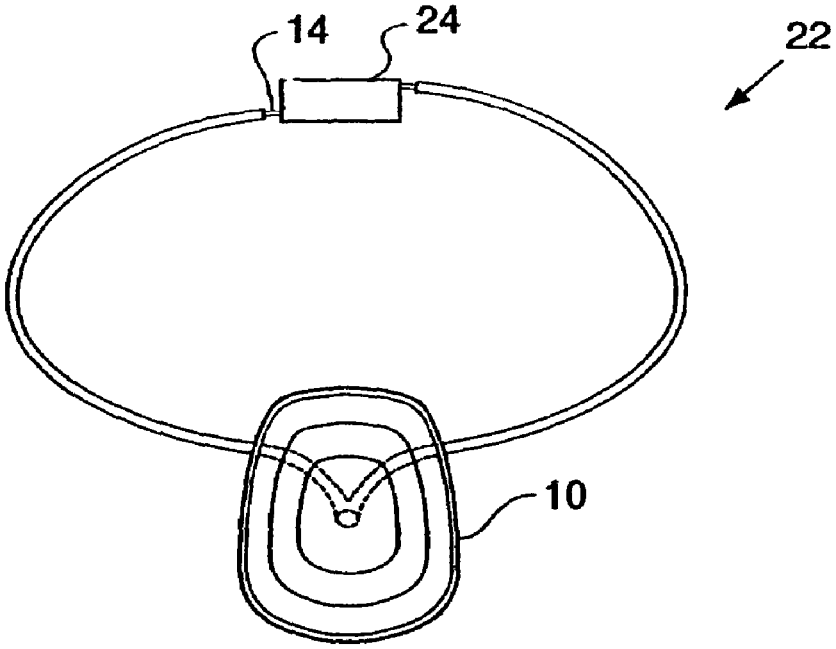
FIG. 2*b* illustrates the article of jewelry in the form of a choker.
Figure 3A:
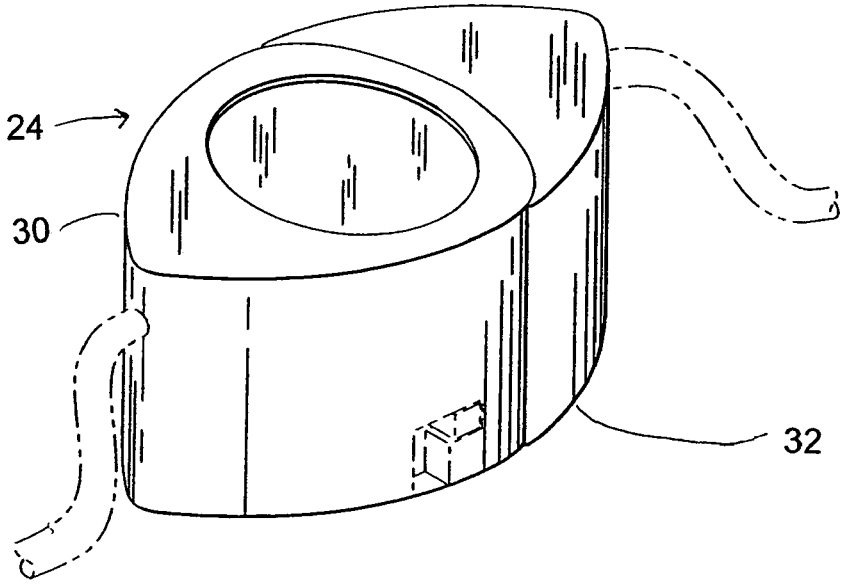
FIG. 3*a* illustrates a two-part switch.
Figure 3B:
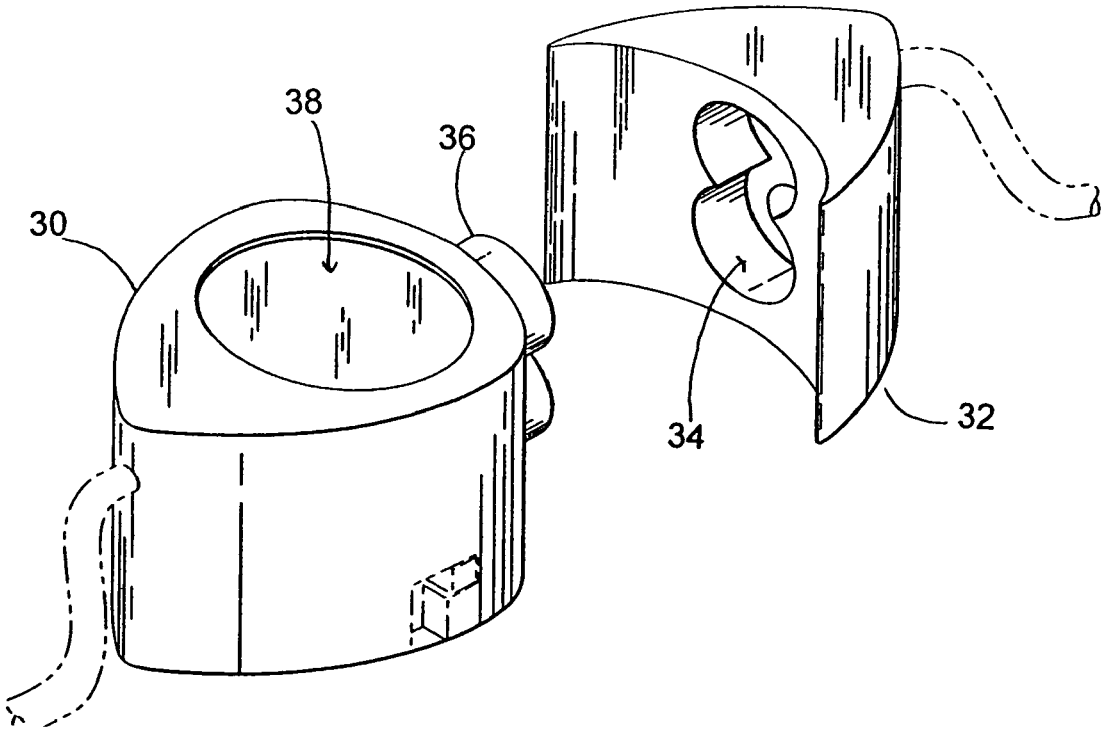
FIG. 3*b* illustrates each component of the two-part switch.
Figure 4A:
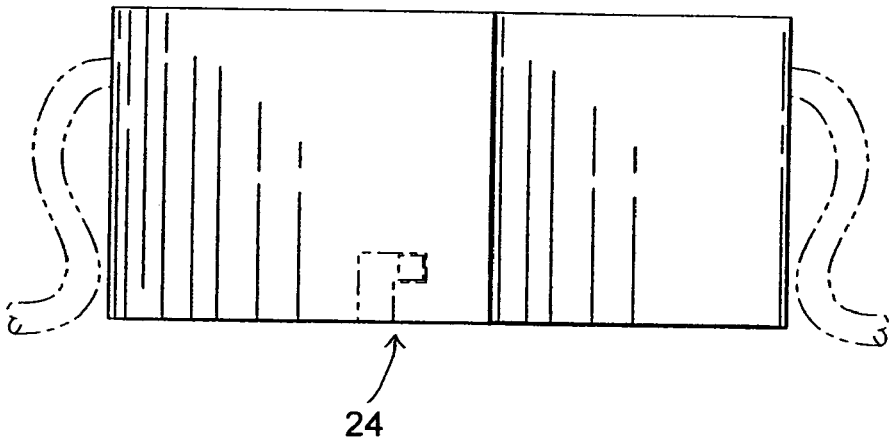
FIG. 4*a* illustrates a side view of the two-part switch.
Figure 4B:
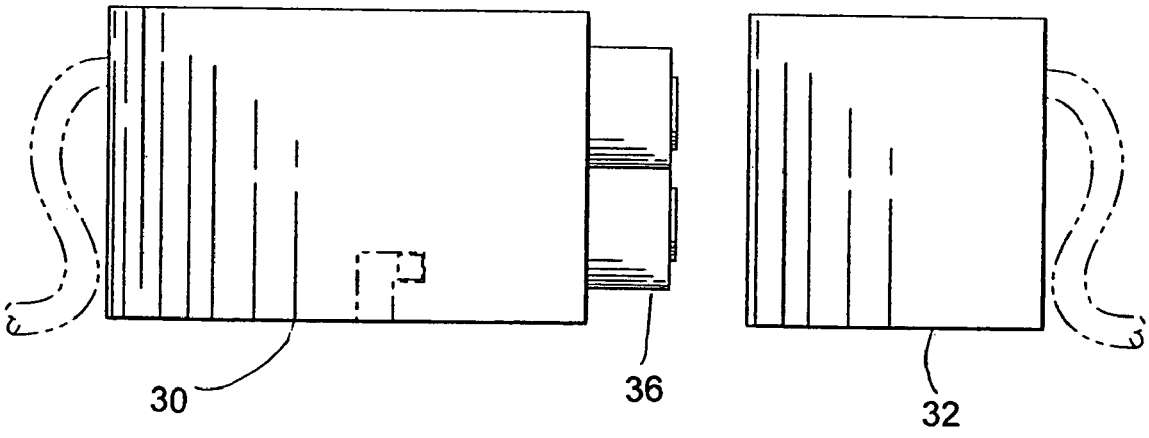
FIG. 4*b* illustrates a side view of the two-part switch.
Figure 5A:
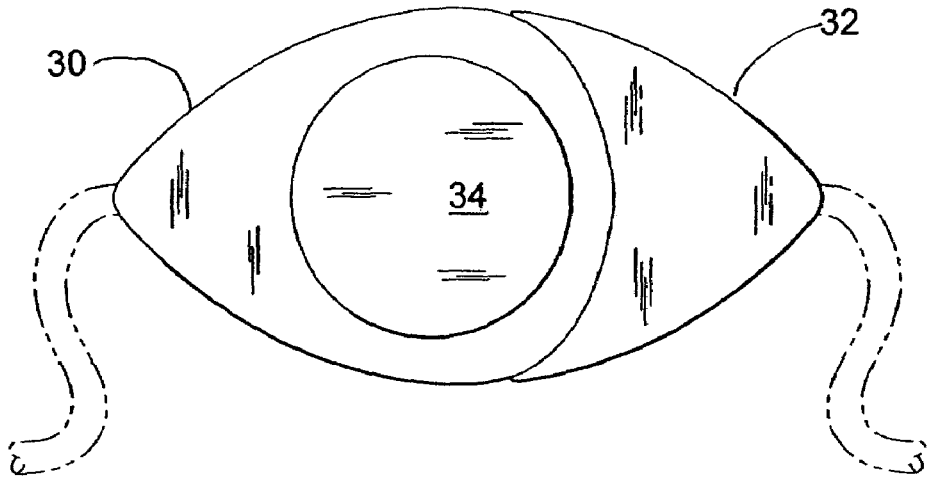
FIG. 5*a* illustrates a top view of the two-part switch.
Figure 5B:
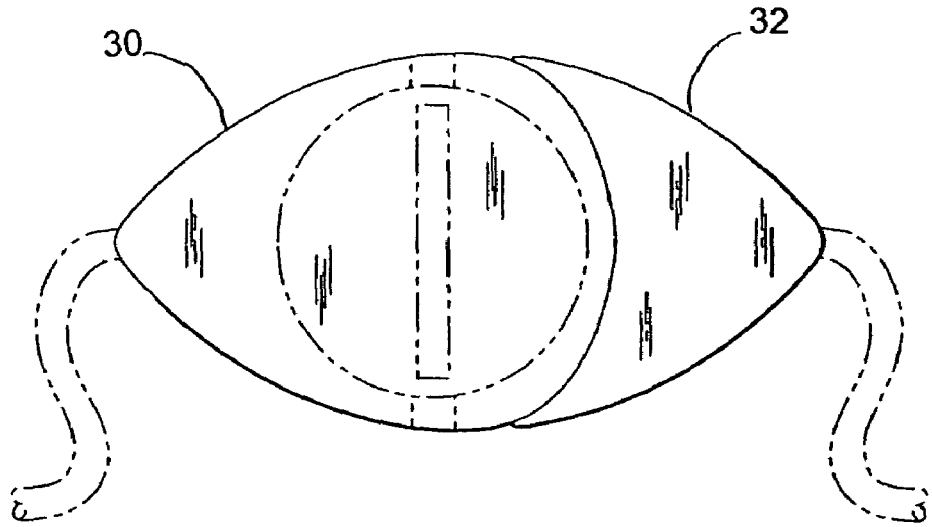
FIG. 5*b* illustrates a bottom view of the two-part switch.
Figure 6A:
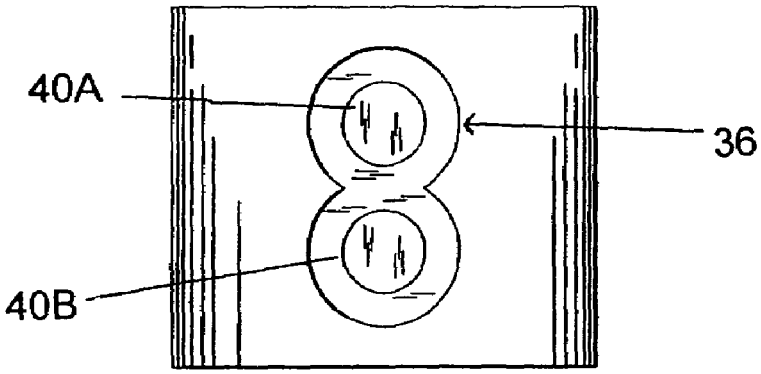
FIG. 6*a* illustrates contact elements of a first part of the switch.
Figure 6B:
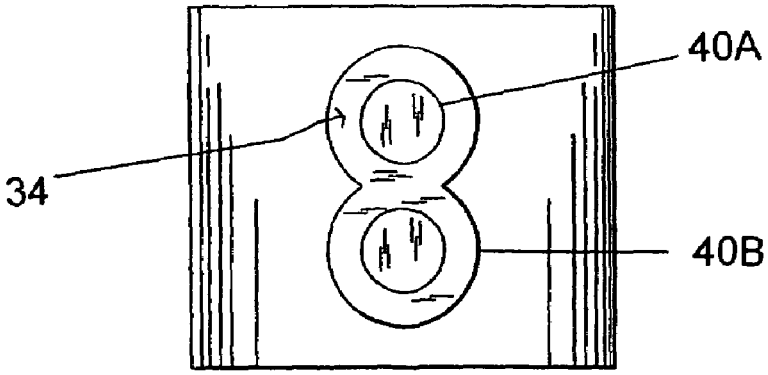
FIG. 6*b* illustrates contact elements of a second part of the switch.

FIG. 2*a* shows the article of jewelry 10 as a necklace 20. The wire 14 provides part of the necklace 20. In some embodiments, the wire 14 is covered by a material. In the depicted embodiment, the wire 14 is covered by a plurality of beads 18. In an alternative embodiment, FIG. 2*b* shows the article of jewelry 10 incorporated into a choker 22. In further alternative embodiments, the article of jewelry 10 is incorporated into a bracelet. In the depicted embodiment, the choker 22 includes a two-part switch 24 (best seen in FIGS.

3A–6B). The two-part switch 24 is electrically connected to the transmutable lighting element 12 through the use of the wire 14. The two-part switch 24 selectively connects the lighting element 12 to the power source.

Referring now to FIGS. 3*a*–6*b*, it can be seen that the two-part switch 24 includes a first member 30 and a second member 32. The first and second members 30, 32 have a complementary design such that they fit together. In the depicted embodiments, the complimentary design is arcuate; however, other shapes may be used. The second member 32 includes a receptacle 34. The first member 30 includes a protrusion 36. In the depicted embodiment, the protrusion is formed by two intersecting columns; however, other shapes may be used. The receptacle 34 and the protrusion 36 are complementary such that they fit together. Optionally, the first member may include a cavity 38. The cavity 38 can be used to receive a label or sticker having a trademark. The two-part switch 24 is made of injection molded plastic and may include a compartment (not shown) to hold a battery. The receptacle 34 and the protrusion 36 each include contacts 40A and 40B. The contacts 40A are "dead" contacts and the contacts 40B are "live" contacts. The term "dead" is defined to mean electrically non-conductive, and the term "live" is defined to mean electrically conductive. This provides each member 30, 32 with one "live" contact 40 B and one "dead" contact 40A. When the "live" contacts 40B line up with one another, the switch is in an "on" position, and when a "dead" contact 40A and a "live" contact 40B are matched together, the switch is in an "off" position.

In the depicted embodiments, the contacts 40A and 40B are magnets. The magnets are used to hold the first member 30 and the second member 32 together. However, in other embodiments a snap-fit may be used to hold the first and second members 30, 32 together. In other words, the first member 30 and the second member 32 may "snap" together. In yet other embodiments, the first and second members 30, 32 each include magnetic inserts in addition to the contacts 40A and 40 B. The magnetic inserts may be used to hold the first and second members 30, 32 together while the contacts 40A and 40B are used as the switching mechanism.

The article of jewelry 10 is assembled by first cutting and tumbling a rose quartz stone 8. Next, a void to receive the transmutable lighting element 12 is created in the rose quartz stone 8. For example, a flat bottom hole is drilled into the rose quartz stone 8 to provide the void. A wire hole is also drilled into the rose quart stone 8 such that wire 14 connected to the transmutable lighting element 12 may be placed therethrough. A transmutable lighting element 12 is mounted within the flat bottom hole of the rose quartz 8. Next, wire 14 connected to the transmutable lighting element 12 are pulled through the wire hole of the rose quartz 8. After installation of the transmutable lighting element 12, opaque epoxy resin is poured into the flat bottom hole to secure the transmutable lighting element. Optionally, a decorative label can be placed over the epoxy resin. Finally, the wire 14 is connected to the two-part switch 24.

In operation, the first and second members 30, 32 are in a first position such that a "dead" magnet and a "live" magnet are aligned. In this first position, the switch is in an "off" position. Thereafter, a user decouples the second member 32 from the first member 30, rotates the second member 32 one hundred eighty degrees, and couples the second member 32 to the first member 30, thereby achieving a second position. In this second position, the "live" and "dead" magnets are aligned such that the switch is in an "on" position. In the "on" position, the transmutable lighting element 12 sequentially emits a plurality of colors in a transitional manner.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, while the decorative stone 10 is orb shaped other shapes are equally applicable. Thus, the breadth and scope of the present invention should not be limited by any of the above-described exemplary embodiments, but should be defined only in accordance with the following claims appended hereto and their equivalents.

What is claimed is:

1. An illuminated article comprising:

lighting element capable of emitting a plurality of colors;

a decorative element attached to said lighting element;

a two-part switch including a first member and a second member being complimentary to said second member, and each member having at least one contact;

said two-part switch having at least two positions, each of said positions attaching said first member and said second member together; and a flexible conductor having an exterior coating of non-conducting composition, the flexible conductor having two ends, each of said ends being attached to one of said first or second switch members and said flexible conductor electrically connecting the two-part switch; and said first position putting said contacts in operative communication to light said lighting element and said second position putting said contacts out of operative communication;

wherein at least one of said contacts is a magnet being deployed to attach said first member and said second member of said switch together in at least one of said positions;

wherein half of magnetic elements are electrically conductive and the other half of magnetic elements are electrically non-conductive.

2. The illuminated article of claim 1, wherein the decorative stone is orb shaped.

3. The illuminated article of claim 1, wherein the decorative stone is made of rose quartz.

4. The illuminated article of claim 1, wherein the decorative stone wherein the decorative stone is made of an opaque plastic.

5. The illuminated article of claim 1, wherein the transmutable lighting element is a light emitting diode.

6. The illuminated article of claim 1, wherein the flexible conductor is made of stainless steel.

7. The illuminated article of claim 1, wherein the non-conducting composition is comprised of nylon.

8. The illuminated article of claim 1, wherein two-part switch is made of injection molded plastic.

9. The illuminated article of claim 1, further comprising a plurality of beads mounted to the flexible conductor.

10. The illuminated article of claim 1, wherein said first member and said second member snap together.

11. The illuminated article of claim 1, wherein at least two of the magnetic elements are electrically conductive.

12. An illuminated article of jewelry, the illuminated article comprising:

a light emitting diode capable of emitting a plurality of colors;

a decorative stone made of rose quartz, the decorative stone having a void for receiving the light emitting diode;

an epoxy for securing the light emitting diode within the void;

a two-part switch including a first arcuate member having a protrusion and a second arcuate member having a receptacle, said first arcuate member being complimentary to said second arcuate member, and said receptacle being adapted to receive said protrusion; and a flexible conductor having an exterior coating of non-conducting composition, the flexible conductor electrically connecting the two-part switch and the light emitting diode;

wherein both the protrusion and the receptacle include magnetic elements, half of magnetic elements are electrically conductive and the other half of magnetic elements are electrically non-conductive; and wherein both the protrusion and the receptacle include electrically conductive elements.

13. The illuminated article of claim 12, wherein the decorative stone is orb shaped.

14. The illuminated article of claim 12, wherein the flexible conductor is made of stainless steel.

15. The illuminated article of claim 12, wherein the two-part switch includes a cavity to receive a label.

16. The illuminated article of claim 12, wherein two-part switch is made of injection molded plastic.

17. The illuminated article of claim 12, further comprising a plurality of beads mounted to the flexible conductor.

18. An illuminated article of jewelry in the shape of a necklace, the illuminated article comprising:

a light emitting diode capable of emitting a plurality of colors;

an orb-shaped decorative stone made of rose quartz, the decorative stone having a flat bottom hole for receiving the light emitting diode;

an opaque epoxy for securing the light emitting diode within the flat bottom hole;

an injection molded two-part plastic switch including a first arcuate member having a protrusion and a second arcuate member having a receptacle, said first arcuate member being complimentary to said second arcuate member, and said receptacle being adapted to receive said protrusion, both the protrusion and the receptacle including magnetic elements, and wherein half of magnetic elements are electrically conductive and the other half of magnetic elements are electrically non-conductive; and a stainless steel flexible conductor having an exterior coating of non- conducting composition substantially made of nylon, the flexible conductor electrically connecting two-part switch and the light emitting diode.

* * * * *